US007602084B2

(12) United States Patent
Chiu et al.

(10) Patent No.: US 7,602,084 B2
(45) Date of Patent: Oct. 13, 2009

(54) POWER SWITCHING CIRCUIT

(75) Inventors: Chien-Szu Chiu, Tao-Yuan Hsien (TW); Mao-Chuan Chang, Tao-Yuan Hsien (TW)

(73) Assignee: AU Optronics Corporation, HsinChu (TW)

( * ) Notice: Subject to any disclaimer, the term of this patent is extended or adjusted under 35 U.S.C. 154(b) by 0 days.

(21) Appl. No.: 12/023,044

(22) Filed: Jan. 31, 2008

(65) Prior Publication Data

US 2008/0179964 A1 Jul. 31, 2008

(51) Int. Cl.
*H01H 47/00* (2006.01)

(52) U.S. Cl. ..... 307/126
(58) Field of Classification Search ..... 307/126
See application file for complete search history.

(56) References Cited

U.S. PATENT DOCUMENTS 4,538,074 A 8/1985 Fraden
6,873,062 B1 3/2005 Makino

*Primary Examiner*—Robert L. Deberadinis
(74) *Attorney, Agent, or Firm*—Winston Hsu

(57) ABSTRACT

A power switching circuit is disclosed. The power switching circuit includes an output switch coupled to a power supply, a control circuit controlling the first switch to output the power supply according to a voltage of a node, and a user switch for receiving a switch signal. Two clock circuits control the voltage of the node according to the period of the switch signal.

19 Claims, 10 Drawing Sheets

POWER SWITCHING CIRCUIT

BACKGROUND OF THE INVENTION

1. Field of the Invention

The present invention provides a switching circuit, and more particularly, a power switching circuit.

2. Description of the Prior Art

Please refer to FIG. 1. FIG. 1 is a diagram illustrating a conventional power switching circuit 100. As shown in FIG. 1, the power source 110 is coupled to a controller 120 and a switch 130. The switch 130 comprises a first end coupled to the power source 110, a second end coupled to an output end for outputting the power received on the first end of the switch 130, and a control end coupled to the controller 120. The power source 110 provides power to the controller 120 so as to enable the controller 120 to work and to control the behavior of the switch 130. The controller 120 controls the switch 130 to output power or not.

Please refer to FIG. 2. FIG. 2 is a diagram illustrating the switch 130. The switch 130 is realized with a P type Metal Oxide Semiconductor (PMOS) transistor. The controller 120 controls the PMOS transistor to be turned on or turned off for outputting the power source 110.

The drawback of the conventional power switching circuit 100 is the controller 120 has to be always activated no matter whether the switch 130 outputs the power source 110 or not. That is, the controller 120 keeps consuming power from the power source 110 and that causes power wasting.

SUMMARY OF THE INVENTION

The present invention provides a power switching circuit. The power switching circuit comprises an output switch comprising a first end coupled to a power; a control end for receiving a first activation signal; and a second end for outputting the power according to the first activation signal received on the control end of the output switch; a user switch comprising a first end coupled to the power; a control end for receiving a second activation signal; and a second end for outputting the power according to the second signal received on the control end of the user switch; a control circuit comprising a control end coupled to the second end of the output switch; a first end coupled to a ground end; and a second end coupled to the control end of the output switch for applying the first activation signal to the control end of the output switch according to a first voltage or a second voltage on the control circuit control end; a first timer circuit coupled between the control circuit control end and the user switch second end for applying the first voltage to the control circuit control end when the duration of the user switch second end applying the power is longer than a first predetermined duration; and a second timer circuit coupled between the control circuit control end and the user switch second end for applying the second voltage to the control circuit control end when the duration of the user switch second end applying the power is longer than a second predetermined duration.

The present invention further provides a power switching circuit. The power switching circuit comprises an user switch comprising an user switch control end for receiving an input signal; an user switch output end for selectively outputting a first activation signal accordingly if the user switch control end receives the input signal; a first timer circuit coupled to the user switch output end for receiving the first activation signal and outputting a first voltage when a duration of the first activation signal lasts longer than a first predetermined duration; a second timer circuit coupled to the user switch output end for receiving the first activation signal and outputting a second voltage when a duration of the first activation signal lasts longer than a second predetermined duration; a control circuit comprising a control circuit control end coupled to the first timer circuit and the second timer circuit for receiving the first voltage and the second voltage; a control circuit output end for outputting a second activation signal when the control circuit output end receives the first voltage and stopping outputting the second activation signal when the control circuit output end receives the second voltage; an output switch comprising an output switch first end coupled to a power; an output switch control end coupled to the control circuit output end for receiving the second activation signal; and an output switch output end for selectively coupling the power to the output switch output end accordingly if the output switch control end receives the second activation signal.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 4 is a diagram illustrating the power switching circuit of the present invention when being turned on.

FIG. 5 is a diagram illustrating the power switching circuit after being turned on.

DETAILED DESCRIPTION

Figure 1:
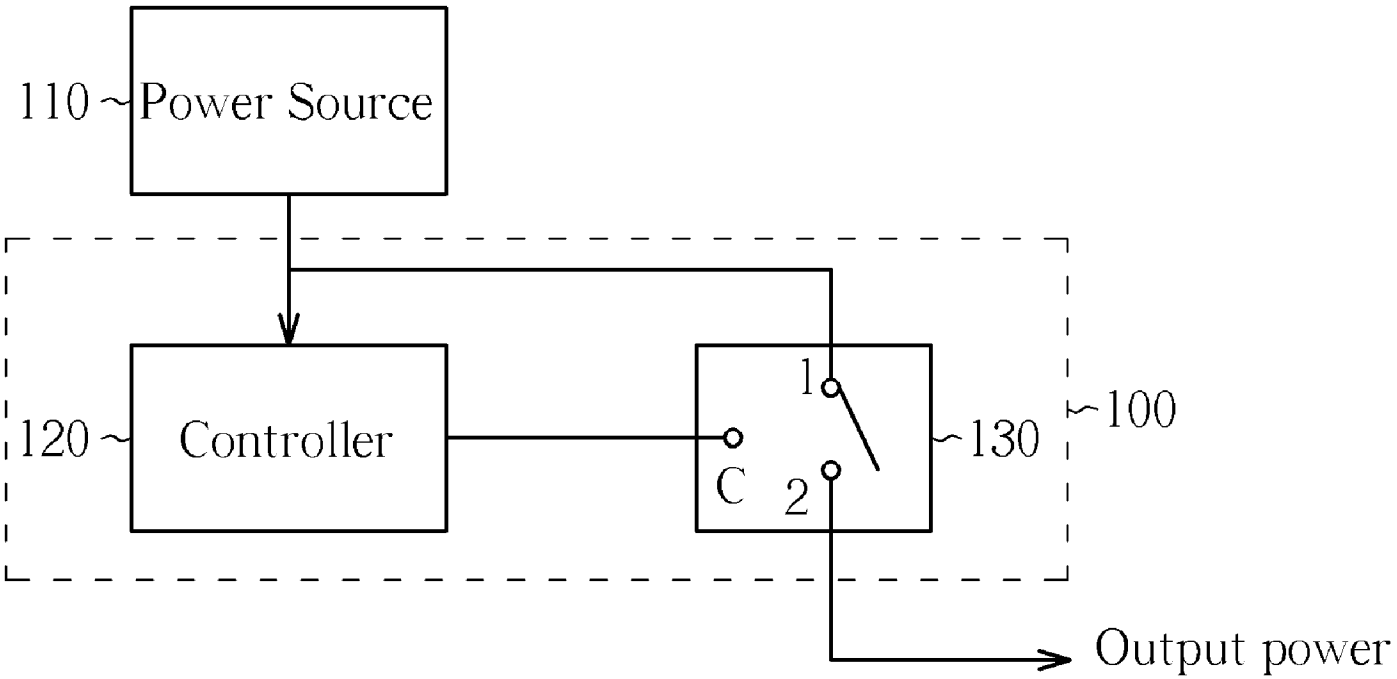
Fig. 1 Prior Art
FIG. 1 is a diagram illustrating a conventional power switching circuit.
Figure 2:
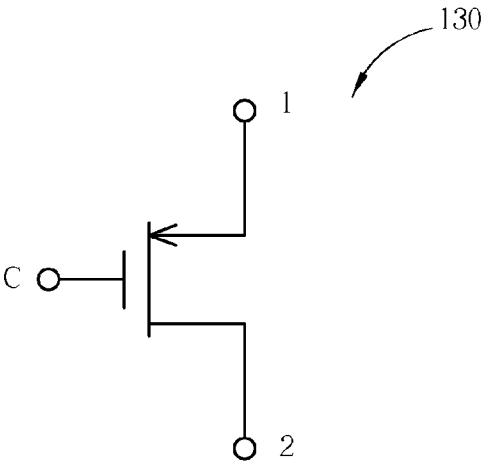
FIG. 2 is a diagram illustrating the switch.
Figure 3:
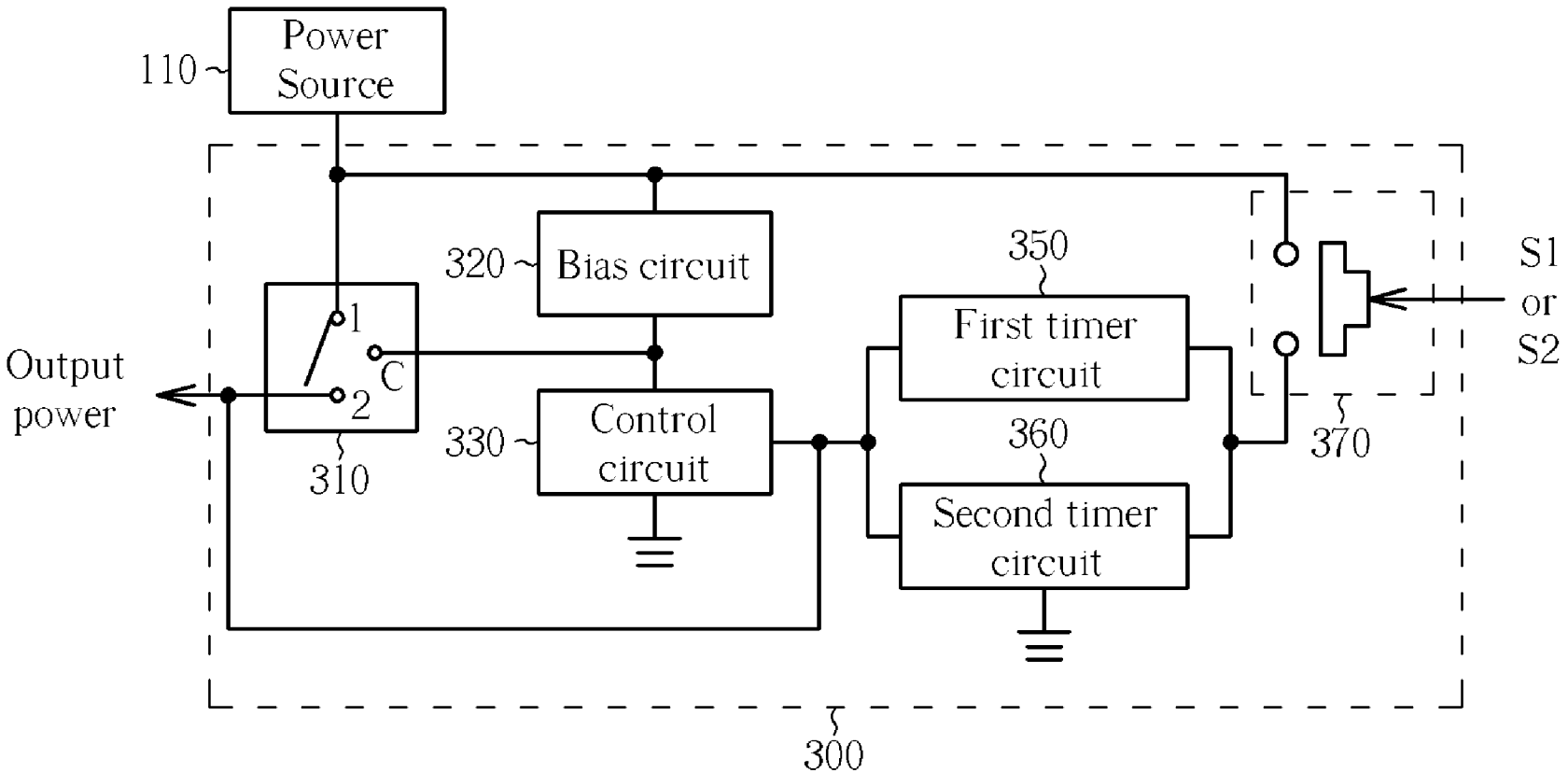
FIG. 3 is a diagram illustrating a power switching circuit of the present invention.

Please refer to FIG. 3. FIG. 3 is a diagram illustrating a power switching circuit 300 of the present invention. As shown in FIG. 3, the power switching circuit 300 comprises an output switch 310, a user switch 370, a bias circuit 320, a control circuit 330, a first timer circuit 350, and a second timer circuit 360.

The output switch 310 comprises a first end coupled to the power source 110 for receiving a first power from the power source 110, a second end for selectively outputting the first power on the first end of the output switch 310, and a control end coupled to the control circuit 330 for controlling the first end of the output switch 310 coupling to the second end of the output switch 310 according to the activation signal of the control circuit 330. The output switch 310 is realized with a PMOS transistor.

The bias circuit 320 is coupled between the control end of the output switch 310 and the power source 110 for biasing the control end of the output switch 310 at a predetermined voltage. Thus, the voltage of the control end of the output switch 310 keeps stable for avoiding the output switch 310 inappropriately turning on or off when the control end of the output switch 310 does not receive the activation signal.

The input end of the control circuit 330 is coupled to the first timer circuit 350 and the second timer circuit 360. The output end of the control circuit 330 is coupled to the control end of the output switch 310. The control circuit 330 applies the activation signal to the control end of the output switch 310 through the output end of the control circuit 330 according to the voltage levels provided by the first timer circuit 350 or the second timer circuit 360. For example, if the input end of the control circuit 330 receives a voltage with a high level, the output switch 310 is turned on; if the input end of the control circuit receives a voltage with a low level, the output switch 310 is turned off.

The input end of the user switch 370 is coupled to the power source 110. The output end of the user switch 370 is coupled to the first timer circuit 350 and the second timer circuit 360. The user switch 370 is realized with a tactile switch. As shown in FIG. 3, when a user presses the user switch 370, the pressed user switch 370 couples the power source 110 to the first timer circuit 350 and the second timer circuit 360 so that the R-C networks of both of the first and the second timer circuits 350 and 360 are enable to be charged by the power source 110. When the user does not press the user switch 370, the user switch 370 does not couple the power source 110 to the first and the second timer circuits 350 and 360.

Input signal S1 represents the power source 110 applying a second power through the user switch 370 when a user presses the user switch 370 for a period T1, and input signal S2 represents the power source 110 applying the second power through the user switch 370 when a user presses the user switch 370 for a period T2. That is, the input signal S1 represents the user switch 370 being pressed for the period T1, the input signal S2 represents the user switch 370 being pressed for the period T2. It is assumed that the period T2 is longer than the period T1. Therefore, the first timer circuit 350 and the second timer circuit 360 are selectively triggered to output voltages to the control circuit 330 by the input signals S1 and S2. The first and the second timer circuits 350 and 360 are triggered to output different voltage levels to the control circuit 330. The control circuit 330 controls the output switch 310 to switch on or off according to the voltages applied from the first and the second timer circuits 350 or 360.

The first timer circuit 350 is coupled between the control circuit 330 and the user switch 370. The first timer circuit 350 outputs a first voltage to the control circuit 330 according to the period of the second power, for example, if the period relation between the periods T1-T4 is: T3<T1<T4<T2, and the first timer circuit 350 is designed to be turned on when the period of the second power is longer than the period T3. Thus, when the user switch 370 is pressed longer than the period T3, the first timer circuit 350 is triggered to apply a first voltage for a predetermined period to the control circuit 330. The predetermined period is determined by the capacitance of the capacitor.

Therefore, when the user switch 370 receives the input signals S1 or S2, the user switch 370 accordingly is turned on for the periods T1 or T2 respectively, which means the first timer circuit 350 receives the second power for the period T1 or the second power for the period T2. The first timer circuit 350 outputs the first voltage (high voltage level) for the predetermined period to the control circuit 330 since the periods T1 and T2 are both longer than the period T3. On the other hand, if the user switch 370 receives the input signal S4, the user switch 370 accordingly is turned on for the periods T4, which means the first timer circuit 350 receives the second power for the period T4. The first timer circuit 350 does not output the first voltage for the predetermined period to the control circuit 330 since the periods T4 is shorter than the period T3.

The second timer circuit 360 is coupled between the control circuit 330 and the user switch 370. The second timer circuit 360 outputs a second voltage to the control circuit 330 according to the period of the second power. For example, it is assumed that the relation between the periods T1-T4 is: T3<T1<T4<T2, and the second timer circuit 360 is designed to be turned on by the period T4. When the user switch 370 is pressed longer than the period T4, which means the period the second timer circuit 360 receives the second power from the power source 110 is longer than the period T4, the second timer circuit 360 outputs a second voltage (low voltage level) to the control circuit 330. When a period the second timer circuit receives the second power is shorter than the period T4, the second timer circuit 360 does not output any voltages to the control circuit 330.

Therefore, when the user switch 370 receives the input signal S1, which means the user switch 370 is turned on for the period T1, the period the second timer circuit 360 receives the second power from the power source 110 is T1. The second timer circuit 360 does not output any voltage to the control circuit 330 since the period T1 is shorter than the period T4. When the user switch 370 receives the input signal S2, which means the user switch 370 is turned on for the period T2, the period the second timer circuit 360 receives the second power from the power source 110 is T2. The second timer circuit 360 outputs the second voltage (low voltage level) to the control circuit 330 since the period T2 is longer than the period T4.

When the user presses the user switch 370 for the period T2, which the user switch 370 receives the input signal S2, and the periods the first and the second timer circuits 350 and 360 receives the second power from the power source 110 are both T2, the first timer circuit 350 and the second timer circuit 360 are sequentially triggered since the period T2 is longer than the periods T3 and T4. Thus, the first timer circuit 350 applies the first voltage of the predetermined period to the control circuit 330. After the first timer circuit 350 finishes applying the first voltage, the second timer circuit 360 applies the second voltage to the control circuit 330.

In a preferred embodiment of the present invention, the output end of the output switch 310 not only outputs the first power but also is coupled to the control circuit 330 as a feedback path for providing a third voltage (high voltage level) to the control circuit 330 when the output switch 310 outputs the first power. In this way, the output switch 310 is kept turned on because of the third voltage when the output switch 310 has already outputted the first power, the first timer circuit 350 does not output the first voltage, and the second timer circuit 360 does not output the second voltage.

When the second timer circuit 360 applies the second voltage (low voltage level) to the control circuit 330, the voltage on the control circuit control end 330 is applied by both the third voltage (high voltage level) applied from the output switch 310 and the second voltage (low voltage level) applied from the second timer circuit 360. Thus, at this time, the voltage on the control circuit control end 330 is possibly indefinite. In order to avoid such condition, the second timer circuit 360 is designed to be stronger than the output switch 310 feedback circuit so that in the above condition, the voltage on the control circuit control end 330 is applied by the second voltage applied from the second timer circuit 360.

Figure 4:
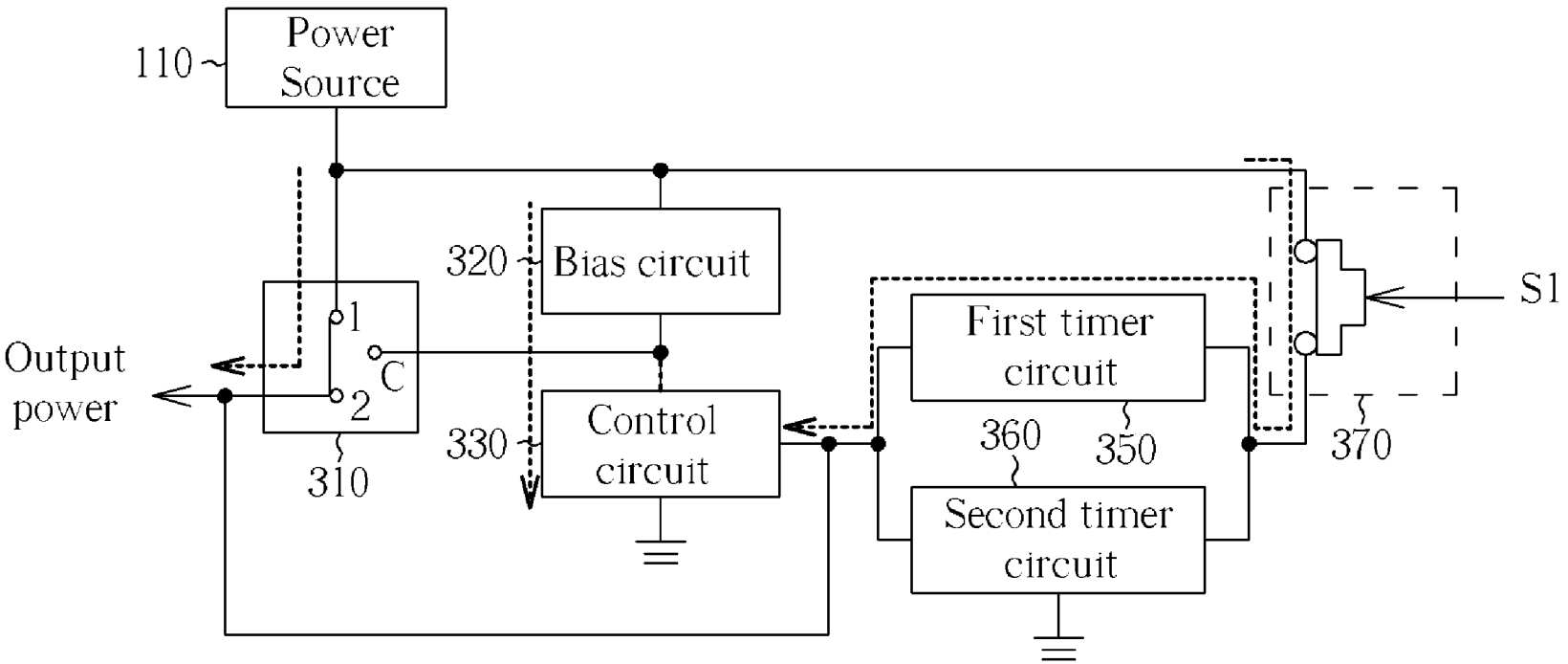

Please refer to FIG. 4. FIG. 4 is a diagram illustrating the power switching circuit 300 of the present invention when being turned on. As shown in FIG. 4, the arrow represents current direction. When the input signal S1 is input to the user switch 370, the conducted current charges the first timer circuit 350 and activates the first timer circuit 350. Thus the first timer circuit 350 applies the first voltage (high voltage level) to the control circuit 330. Consequently, the control circuit 330 applies the activation signal to the output switch 310. The output switch 310 couples the first end of the output switch 310 to the second end of the output switch 310 for outputting the first power from the power source 110.

Figure 5:
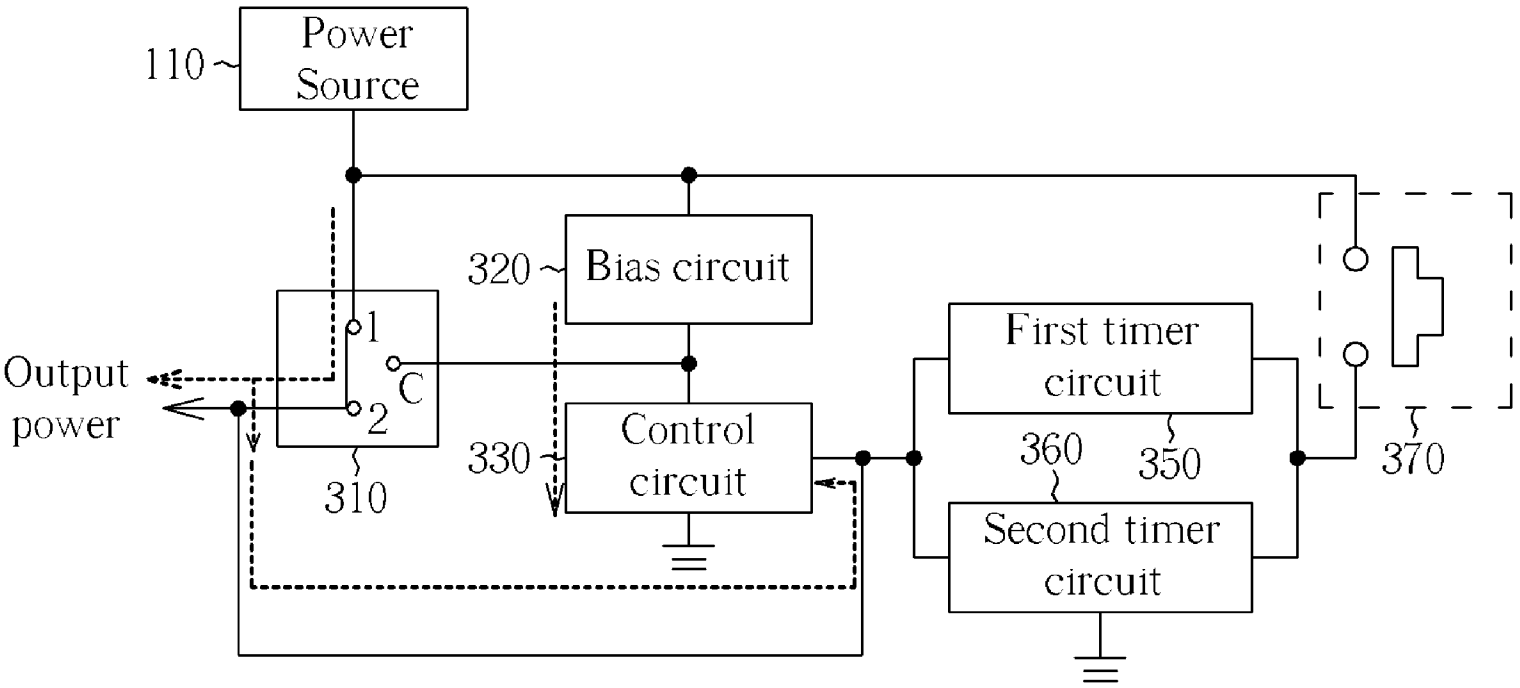

Please refer to FIG. 5. FIG. 5 is a diagram illustrating the power switching circuit 300 after being turned on. As shown in FIG. 5, the arrow represents the current direction. After the period the signal S1 input to the user switch 370 and the output switch 310 couples the first end of the output switch 310 and the second end of the output switch 310, which means the second end of the output switch 310 applies the third voltage to the control circuit 330 so that the control circuit 330 is kept outputting the activation signal to the output switch 310. In this way, the second power from the power source 110 is still output when the output switch 310 outputs the first power, the first timer circuit 350 does not output the first voltage, and the second timer circuit 360 does not output the second voltage.

Figure 6:
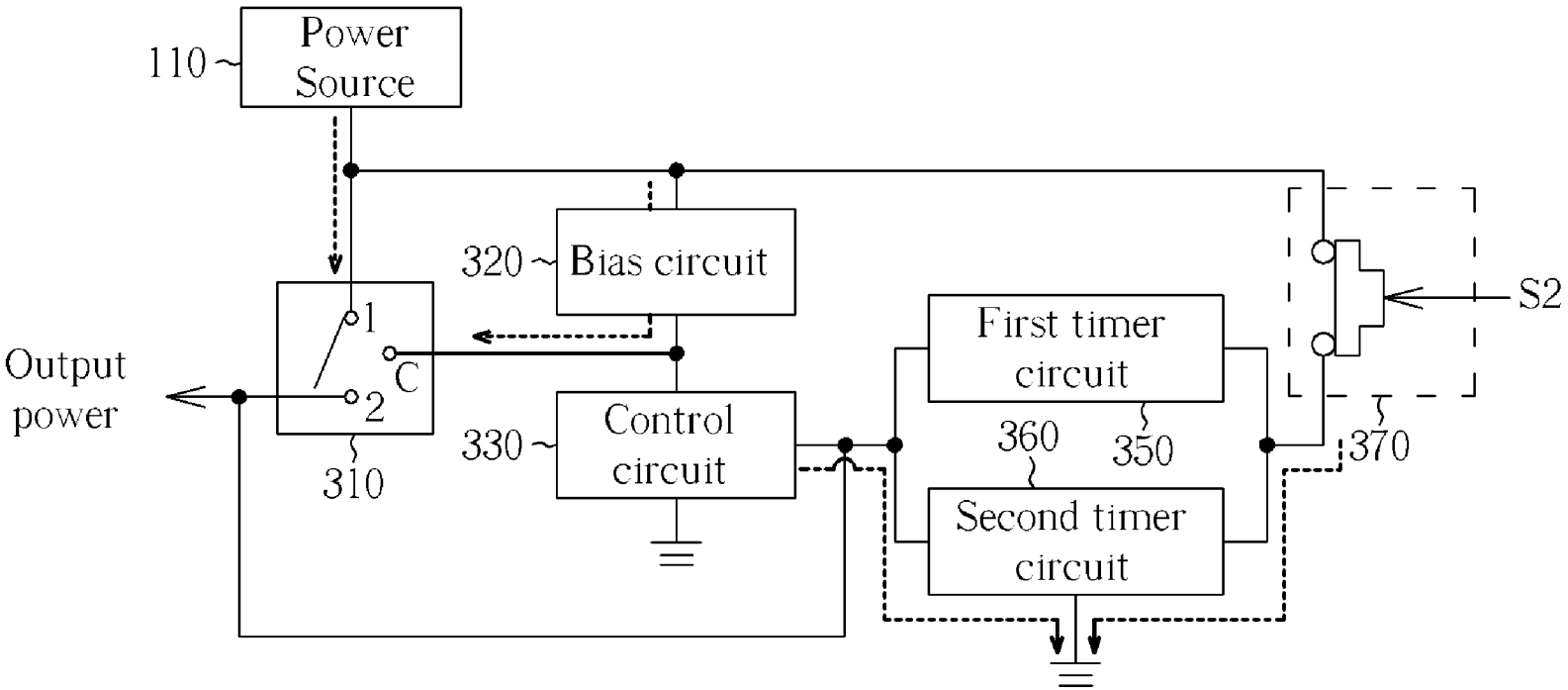
FIG. 6 is a diagram illustrating the power switching circuit of the present invention when being turned off.

Please refer to FIG. 6. FIG. 6 is a diagram illustrating the power switching circuit 300 of the present invention when being turned off. As shown in FIG. 6, when the user switch 370 is input with the input signal S2, since the period of the second power conducted is longer than the periods T3 and T4, the first and the second timer circuits 350 and 360 are triggered.

After being charged for the period T3, the first timer circuit 350 is activated and outputs the first voltage for the predetermined period to the control circuit 330. At this time, the output switch 310 is turned on, the voltage on the control circuit control end 330 is high because the control circuit 330 receives the third voltage from the output switch 310 (high voltage level) and the first voltage (high voltage level) from the first timer circuit 350. Thus, the control circuit 330 is kept turning the output switch 310 on.

After being charged for the period T4, the second timer circuit 360 is activated to output the second voltage (low voltage level) to the control circuit 330. At this time, since the third voltage (high voltage level) and the second voltage (low voltage level) are both applied to the control circuit control end 330, the voltage on the control circuit control end 330 is pulled low by the second voltage from the second timer circuit 360 which is designed stronger than the output switch 310 feedback circuit. Therefore, the control circuit 330 stops applying the activation signal to the output switch 310 due to the low voltage on the control circuit control end 330. Consequently, the output switch 310 receives no activation signal, and the first end of the output switch 310 and the second end of the output switch 310 are not coupled, which disables the first power of the power source 110 from being output.

Figure 7:
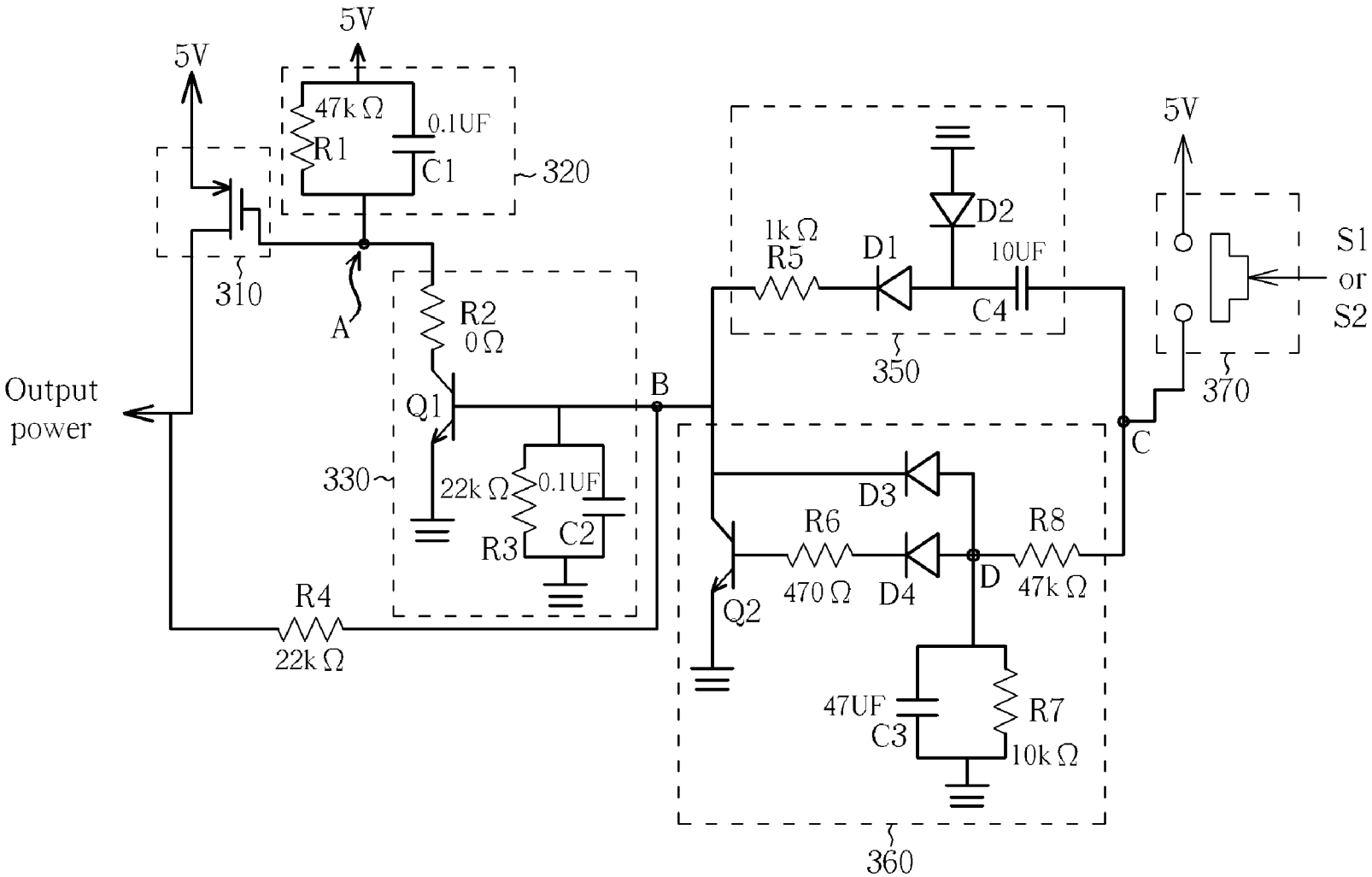
FIG. 7 is a circuit diagram illustrating the power switching circuit of the present invention.

Please refer to FIG. 7. FIG. 7 is a circuit diagram illustrating the power switching circuit 300 of the present invention. It is assumed that the power source 110 output 5 volts, the output switch 310 is a PMOS transistor. The bias circuit 320 comprises a resistor R1 and a capacitor C1. The control circuit 330 comprises a Bipolar Junction Transistor (BJT) Q1, two resistors R2 and R3, and a capacitor C2. The second end of the output switch 310 can be directly coupled to the control circuit 330, or coupled to the control circuit 330 through a resistor R4 (in FIG. 7, it is only shown that the output switch 310 is coupled to the control circuit 330 through the resistor R4). The first timer circuit 350 comprises a resistor R5, two diodes D1 and D2, and a capacitor C4. The second timer circuit comprises a BJT Q2, three resistors R6, R7, and R8, two diodes D3 and D4, and a capacitor C3. The user switch 370 is a tactile switch. The resistances and the capacitances in FIG. 7 are described as follows: resistor R1 is 47K ohm (K=1000), resistor R2 is 0 ohm, resistor R3 is 22K ohm, resistor R4 is 22K ohm, resistor R5 is 1K ohm, resistor R6 is 470 ohm, resistor R7 is 10K ohm, resistor R8 is 47K ohm, capacitor C1 is 0.1 U farad ($U=10^{-6}$), capacitor C2 is 0.1 U farad, capacitor C3 is 47 U farad, and capacitor C4 is 10 U farad.

Please continue referring to FIG. 7. The control end of the output switch 310 is coupled to the node A, the first end of the output switch 310 is coupled to the power source 110 with 5 volts, the second end of the output switch 310 is used for outputting the first power with 5 volts.

In bias circuit 320, the resistor R1 is coupled to the capacitor C1 in parallel. One end of the resistor R1 is coupled to the first power with 5 volts, and the other end of the resistor R1 is coupled to the node A. In this way, the first power with 5 volts is applied to the control end of the output switch 310, which means biases the control end of the output switch 310 at 5 volts. Thus, regularly, the output switch 310 does not turn on because the control end of the output switch 310 and the first end of the output switch 310 are both biased at 5 volts. If the voltage on the control end of the output switch 310 is lower than the voltage on the first end of the output switch 310 by the threshold voltage of the output switch 310 (assuming the threshold voltage is 1 volt), which means the voltage on the control end of the output switch 310 is lower than 4 volts, the output switch 310 is turned on and outputs the first power with 5 volts. Additionally, the capacitor C1 is disposed for speeding the rising of the voltage on the control end of the output switch 310.

In control circuit 330, the resistor R2 is coupled to the node A and the second end of the BJT Q1. Generally the resistance of the resistor R2 is set to be 0 ohm, but when the first power supplies a higher voltage such as 10 volts, the resistance of the resistor R2 is set to be an appropriate value so as to bias the voltage on the node A at an appropriate range no matter whether the BJT Q1 is turned on or turned off and avoid the voltage between the gate and the source of the output switch 310 exceeding the working range. The first end of the BJT Q1 is coupled to a ground (assuming 0 volt), the second end of the BJT Q1 is coupled to the resistor R2, and the BJT control end Q1 is coupled to the node B. Thus, when the voltage on the node B is higher than the threshold voltage (assuming 0.7 volts), the BJT Q1 is turned on, which pulls the voltage of the second end of the BJT Q1 down to 0.2 volts. Thus, when the BJT Q1 is not turned on, the voltage on the node A is 5 volts, which turns off the output switch 310. When the BJT Q1 is turned on, the voltage on the node A becomes to be 0.2 volts, which turns on the output switch 310. The resistor R3 and the capacitor C2 are coupled in parallel between the node B and the ground. The resistor R3 and the capacitor C2 are disposed for slowing down the voltage rising on the node B, which disables the BJT Q1 to be turned on immediately when a high voltage is applied to the node B.

The resistor R4 is coupled between the second end of the output switch 310 and the node B. When the output switch 310 is turned on and outputs 5 volts, the voltage on the node B is biased at 5 volts through the resistor R4. In this way, the BJT Q1 is kept being turned on and applying the voltage on the node A down to 0.2 volts, which keeps the output switch 310 turning on and outputting 5 volts.

In the first timer circuit 350, the resistor R5 is coupled between the node B and the diode D1, the capacitor C4 is coupled between the node C and the diode D1, the diode D2 is coupled between the capacitor C4 and the ground. When the user switch 370 receives input signals and the second power with 5 volts is applied to the node C, the voltage on the node C rises and the capacitor C4 is charged. Thus, before the capacitor C4 finishes being charged, the second power with 5 volts is further applied to the node B through the diode D1 and the resistor R5. Consequently, the voltage on the node B is raised, and the speed of the rising is decided by the resistor R3 and the capacitor C2. The first timer circuit 350 is designed to apply the second power with 5 volts for raising the voltage on the node B when the duration of the input signal is longer than a predetermined duration. For example, assuming the predetermined duration is T3 and T3<T1. Thus, the input signal S1 enables the voltage on the node B to rise high enough so as to pull down the voltage of the node A to 0.2 volts. Thus, the output switch 310 is turned on and outputs the first power. Additionally, the diode D1 is disposed for avoiding resistor R4 inversely applying the second power with 5 volts to the capacitor C4 and causing functional failure. The diode D2 is disposed for providing a current path to enable the capacitor C4 to sink current from the ground when the user switch 370 is turned off.

In the second timer circuit 360, the first end of the BJT Q2 is coupled to the ground, the second end of the BJT Q2 is coupled to the node B, and the control end is coupled to the node C through the resistor R6, the diode D4, and the resistor R8. The capacitor C3 and the resistor R7 are connected in parallel between the ground and the node D. The diode D3 is coupled between the node D and the second end of the BJT Q2. When the user switch 370 receives input signals and applies the second power with 5 volts to the node C, the capacitor c3 is charged through the resistor R8, and the voltage on the node D gradually raises. The speed of the voltage rising is decided by the resistor R7 and the capacitor C3. When the voltage on the node D is higher than the summation of threshold voltage of the BJT Q2 and the diode D4, the BJT Q2 is turned on, which pulls the voltage on the node B down. The diode D4 is disposed for raising the voltage that turns the BJT Q2 on. That is, the voltage across the diode D4 is 0.7 volts, the threshold voltage of the BJT Q2 is 0.7 volts, and thus the voltage on the node D has to be higher than (0.7+0.7)=1.4 volts for turning the BJT Q2 on. The second timer circuit 360 is designed to pull down the voltage on the node B to 0.2 volts if the duration of the input signal is longer than a predetermined duration. For example, assuming the predetermined duration for triggering the second timer circuit 360 to turn on the BJT Q2 is T4, if the user switch 370 receives an input signal S2, the duration the second power with 5 volts charging the second timer circuit 360 is T2. Thus the input signal S2 applies the voltage on the node B down to 0.2 volts through the second timer circuit 360, which turns on the BJT Q1 and the voltage on the node A keeps at 5 volts. Thus, the output switch 310 is turned off and does not output the first power.

In FIG. 7, the input signal S1 is designed with the duration of 2.2 ms (milli-second) (R3×C2=0.1 U×22K=2.2 ms) for activating the first timer circuit 350 so as to apply the voltage on the node B up to 0.7 volts, which turns on the BJT Q1 (the above description is only an estimation, and the actual result differs from the ideal). The input signal S2 is designed with the duration of 353 ms [(C3×R8)×[R7/(R7+R8)]=47K×47 U×[10K/(10K+47K)=353 ms] for activating the second timer circuit 360 so as to apply the voltage on the node B down to 0.2 volts, which turns the BJT Q1 off (the above description is only an estimation, and the actual result differs from the ideal). In this way, when the user switch 370 is pressed for 2.2 ms, the power switching circuit of the present invention outputs the first power, and when the user switch 370 is pressed for 353 ms, the power switching circuit of the present invention stops outputting the first power.

Figure 8:
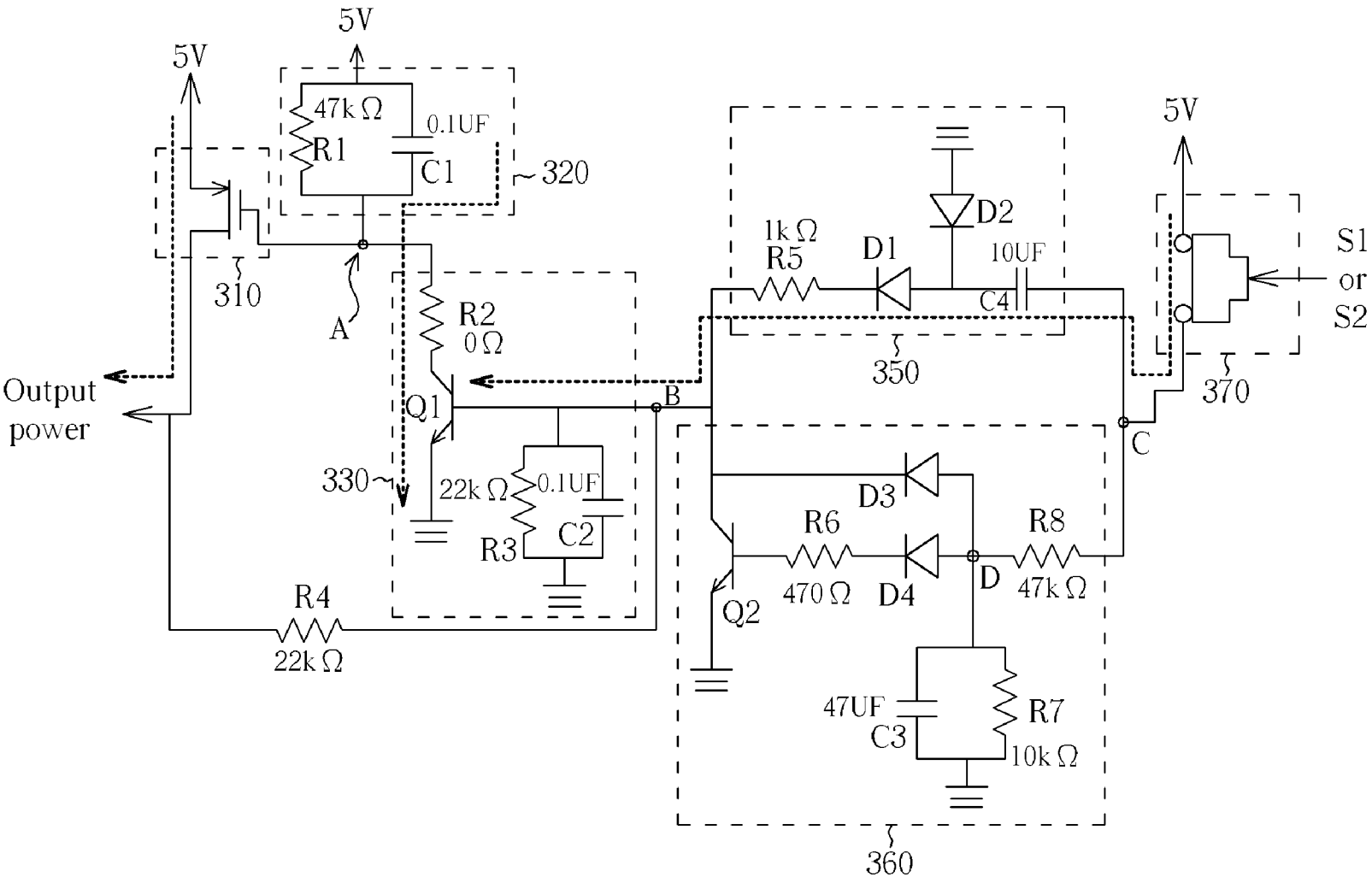
FIG. 8 is a diagram illustrating the operation of the circuit in FIG. 7 when receiving an input signal.

Please refer to FIG. 8. FIG. 8 is a diagram illustrating the operation of the circuit in FIG. 7 when receiving the input signal S1. As shown in FIG. 8, the arrow represents the current direction. When the input signal S1 turns on the user switch 370, the current from the second power with 5 volts flows through the user switch 370 into the control circuit 330, which charges the capacitor C2. When the voltage over the capacitor C2 is charged up to 0.7 volts, the BJT Q1 is turned on, which pulls the voltage of the node A down and turns on the output switch 310 for outputting the first power.

Figure 9:
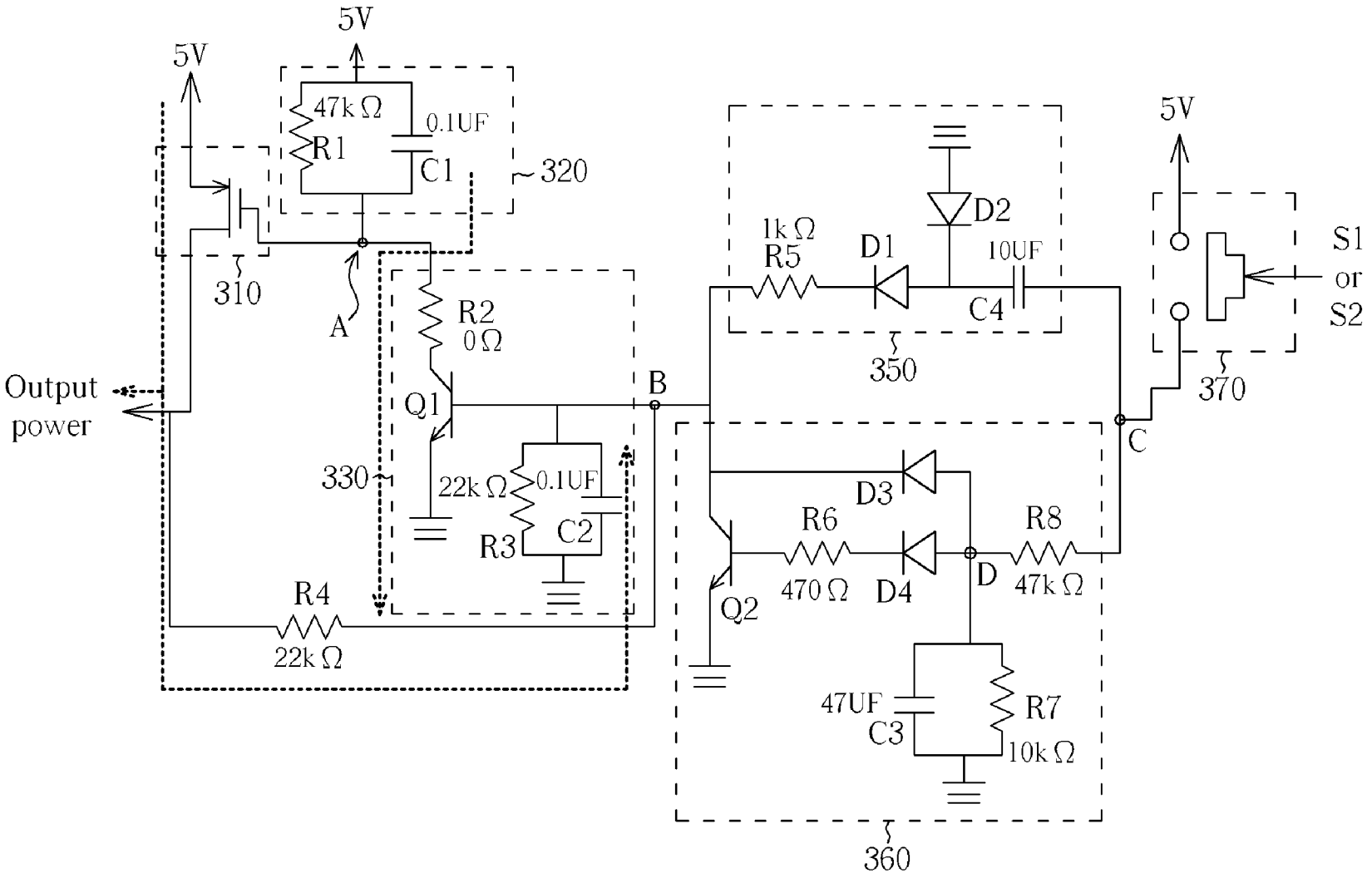
FIG. 9 is a diagram illustrating the operation of the circuit in FIG. 7 after activated.

Please refer to FIG. 9. FIG. 9 is a diagram illustrating the operation of the circuit in FIG. 7 after activation. As shown in FIG. 9, the arrow represents the current direction. After the output switch 310 is turned on for outputting the first power, the first power flows back to the node B through the resistor R4, which keeps the BJT Q1 turning on. Thus the voltage on the node A is kept at 0.2 volts and the output switch 310 is kept turning on.

Figure 10:
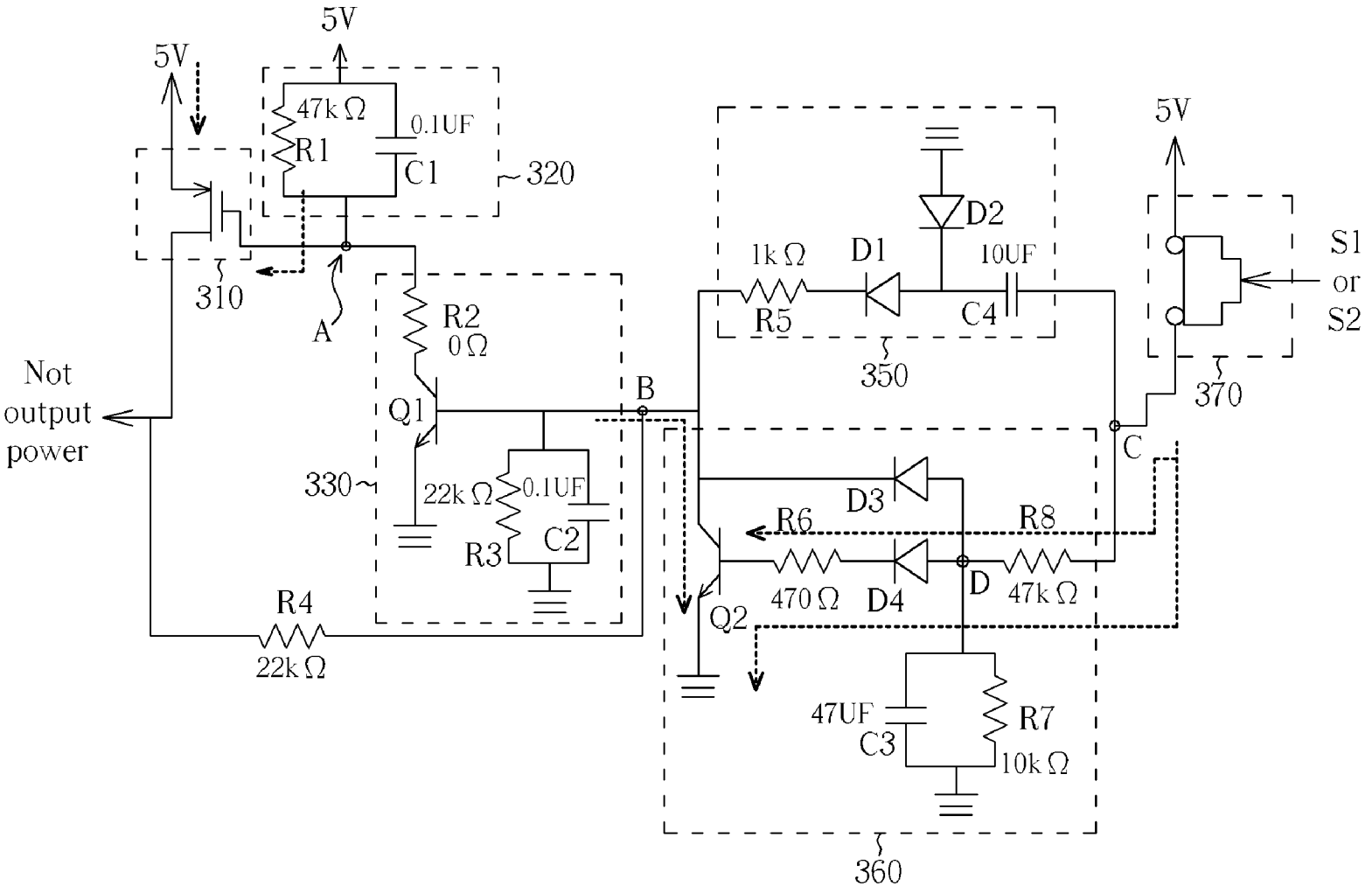
FIG. 10 is a diagram illustrating the operation of the circuit in FIG. 7 after receiving another input signal.

Please refer to FIG. 10. FIG. 10 is a diagram illustrating the operation of the circuit in FIG. 7 after receiving the input signal S2. As shown in FIG. 10, the arrow represents the current direction. When the input signal S2 turns on the user switch 370, the current from the second power with 5 volts flows through the user switch 370 into the first timer circuit 350 and the second timer circuit 360 so that the BJT Q2 is turned on and the voltage on the node B is pulled down. Thus, the capacitor C2 is discharged, which disables the BJT Q1 to pull the voltage on the node A down. Meanwhile, the bias circuit 320 applies the voltage on the node A up so as to turn the output switch 310 off and stop outputting the first power.

To sum up, the power switching circuit of the present invention decides to output power according to the duration of the user pressing the tactile switch. Once the power switching circuit of the present invention outputs power, the tactile switch is released from keeping being pressed. Overall, the power switching circuit of the present invention does not have to be controlled by a controller. Thus, the power consumption is saved and the power efficiency is raised.

Those skilled in the art will readily observe that numerous modifications and alterations of the device and method may be made while retaining the teachings of the invention.

What is claimed is:

1. A power switching circuit comprising:

an output switch comprising:

an output switch first end for receiving a first power from a power source;

an output switch control end for receiving a first activation signal; and an output switch second end for outputting the first power when the first activation signal received on the output switch control end;

a user switch comprising:

a user switch first end for receiving a second power from the power source;

a user switch control end for receiving a second activation signal; and a user switch second end for outputting the second power when the second signal received on the user switch control end;

a control circuit comprising:

a control circuit control end coupled to the output switch second end; and a control circuit second end coupled to the output switch control end and applying the first activation signal to the output switch control end according to whether a first voltage and a second voltage applied on the control circuit control end;

a first timer circuit coupled between the control circuit control end and the user switch second end, the first timer circuit applying the first voltage to the control circuit control end when the time duration of the second power applied through the user switch second end is longer than a first predetermined duration; and a second timer circuit coupled between the control circuit control end and the user switch second end, the second timer circuit applying the second voltage to the control circuit control end when the time duration of the second power applied through the user switch second end is longer than a second predetermined duration.

2. The power switching circuit of claim 1 further comprising a bias circuit coupled between the power source and the output switch control end for applying a high voltage on the output switch control end when there is no first activation signal.

3. The power switching circuit of claim 1 further comprising a feedback resistor coupled between the output switch second end and the control circuit control end for adjusting a feed back voltage feeding back from the output switch to the control circuit control end.

4. The power switching circuit of claim 1 wherein the output switch comprising a P-type Metal Oxide Semiconductor (PMOS) transistor, and the output switch first end and third end corresponding to the source and drain of the PMOS transistor, and the output switch control end corresponding to the gate of the PMOS transistor.

5. The power switching circuit of claim 1 wherein the user switch is a tactile switch and when the tactile switch is pressed, the user switch first end is coupled to the user switch second end, and when the tactile switch is not pressed, the user switch first end is disconnected from the user switch second end.

6. The power switching circuit of claim 1 wherein the control circuit comprises a Bipolar Junction Transistor (BJT), and the control circuit control end corresponding to the BJT base, the control circuit second end corresponding to the BJT collector.

7. The power switching circuit of claim 1 wherein the control circuit further comprises a control circuit first end coupling to a ground, and a resistor coupled between the control circuit first end and the control circuit control end.

8. The power switching circuit of claim 1 wherein the first timer circuit comprises:

a capacitor coupled between the user switch second end and a node;

a first diode coupled between the node and the ground end; and a second diode coupled between the node and the control circuit control end.

9. The power switching circuit of claim 8 wherein the first timer circuit further comprises a resistor coupled between the second diode and the control circuit control end.

10. The power switching circuit of claim 1 wherein the second timer circuit comprises:

a BJT comprising:

a first end coupled to a ground;

a control end coupled to the user switch second end; and a second end coupled to the control circuit control end;

a capacitor coupled between the BJT control end and the ground; and a first resistor parallel connected at two ends of the capacitor.

11. The power switching circuit of claim 10 wherein the second timer circuit further comprises a second resistor coupled between the capacitor and the BJT control end.

12. The power switching circuit of claim 11 wherein the second timer circuit further comprises a diode coupled between the capacitor and the second resistor.

13. The power switching circuit of claim 12 wherein the second timer circuit further comprises a third resistor coupled between the user switch second end and the capacitor.

14. A power switching circuit comprising:

a user switch comprising:

a user switch control end for receiving an input signal; and a user switch output end for selectively outputting a first activation signal when the user switch control end receives the input signal;

a first timer circuit coupled to the user switch output end for receiving the first activation signal and outputting a first voltage when the first activation signal lasting longer than a first predetermined duration;

a second timer circuit coupled to the user switch output end for receiving the first activation signal and outputting a second voltage when the first activation signal lasting longer than a second predetermined duration;

a control circuit comprising:

a control circuit control end coupled to the first timer circuit and the second timer circuit for receiving the first voltage and the second voltage; and a control circuit output end for outputting a second activation signal when the control circuit control end receiving the first voltage, the control circuit output end stopping outputting the second activation signal when the control circuit output end receiving the second voltage; and an output switch comprising:

an output switch first end coupled to a power source;

an output switch control end coupled to the control circuit output end for receiving the second activation signal; and an output switch output end selectively coupled to the power source when the output switch control end receiving the second activation signal.

15. The power switching circuit of claim 14 wherein the output switch output end is coupled to the control circuit control end, when the power source is coupled to the output switch output end, the output switch output end feeding back a third voltage to the control circuit control end, and the control circuit outputting the second activation signal when the third voltage appeared to the control circuit control end.

16. The power switching circuit of claim 15 wherein the driving strength of the output switch output end is lower than that of the second timer circuit so that when the output switch output end feeds back the third voltage to the control circuit control end and the second timer circuit simultaneously outputs the second voltage to the control circuit control end, the voltage of the control circuit control end is driven to the second voltage.

17. The power switching circuit of claim 14 wherein the user switch is a tactile switch and when the tactile switch is pressed, the user switch first end is coupled to the user switch second end, and when the tactile switch is not pressed, the user switch first end is not coupled to the user switch second end.

18. The power switching circuit of claim 14 wherein the first timer circuit comprises:

a capacitor coupled to the user switch output end and a node;

a first diode coupled between the node and the ground; and a second diode coupled between the node and the control circuit control end.

19. The power switching circuit of claim 14 wherein the second timer circuit comprises:

a BJT comprising;

a first end coupled to the ground;

a control end coupled to the user switch output end; and a second end coupled to the control circuit control end;

a capacitor coupled between the BJT control end and the ground; and a first capacitor parallel connected to two ends of the capacitor.

* * * * *

UNITED STATES PATENT AND TRADEMARK OFFICE

CERTIFICATE OF CORRECTION

PATENT NO. : 7,602,084 B2
APPLICATION NO. : 12/023044
DATED : October 13, 2009
INVENTOR(S) : Chien-Szu Chiu et al.

It is certified that error appears in the above-identified patent and that said Letters Patent is hereby corrected as shown below:

On the title page, add Item (30), Foreign Application Priority Data
"Jan. 31, 2007 (TW).....096103541"

Signed and Sealed this

Fifteenth Day of December, 2009

David J. Kappos

David J. Kappos
*Director of the United States Patent and Trademark Office*